US005363602A

United States Patent [19]

Anthon et al.

[11] Patent Number: 5,363,602

[45] Date of Patent: Nov. 15, 1994

[54] BLADE SHARPENER

[75] Inventors: John R. Anthon, Getzville; James V. Cox, West Seneca; Scott L. Sullivan, Chappaqua, all of N.Y.

[73] Assignee: The Great American Tool Company, Inc., Getzville, N.Y.

[21] Appl. No.: 178,638

[22] Filed: Jan. 7, 1994

Related U.S. Application Data

[60] Continuation of Ser. No. 60,692, May 10, 1993, abandoned, which is a continuation of Ser. No. 849,288, Mar. 10, 1992, abandoned, which is a division of Ser. No. 405,471, Sep. 11, 1989, Pat. No. 5,138,801.

[51] Int. Cl.[5] ..... B24B 3/54

[52] U.S. Cl. ..... 451/540; 451/557; 451/555; 451/367

[58] Field of Search ..... 51/204, 205 R, 205 WG, 51/214, 285, 218 R; 81/177.2, 177.6, 490, 491; 76/82, 88; 16/110 R, 111 R; 269/3; 30/340, 341, 342, 343, 344

[56] References Cited

U.S. PATENT DOCUMENTS

| | | | |
|---|---|---|---|
| 4,091,497 | 5/1978 | Bade | 16/110 R |
| 4,471,951 | 9/1984 | LeVine | 269/3 |
| 4,486,982 | 12/1984 | Longbrake | 51/68 |
| 4,798,108 | 1/1989 | Wilson | 81/170 |

*Primary Examiner*—M. Rachuba
*Attorney, Agent, or Firm*—Darby & Darby

[57] ABSTRACT

A portable blade sharpening system including a sharpening device having a main body and a clamping bar for securing a blade to be sharpened. Guide arms having openings are attached to the main body for receiving and guiding a support rod. The support rod is attached to a sharpening hone holder and is movable between a retracted and extended position. The sharpening hone holder has a channel for housing the support rod when it is in the retracted position. The clamping bar includes recessions for providing it with a lowprofile adjacent the clamped blade. The openings of the guide arms are substantially rectangular so that a consistent cutting angle is maintained.

4 Claims, 3 Drawing Sheets

BLADE SHARPENER

This is a continuation of application Ser. No. 08/060,692, filed May 10, 1993, now abandoned, which is a continuation of Ser. No. 7/849,288 filed Mar. 10, 1992 now abandoned, which was a divisional of Ser. No. 7/405,471 filed Sep. 11, 1989 now U.S. Pat. No. 5,138,801.

FIELD OF THE INVENTION

The present invention relates generally to sharpening devices for sharpening the edge of a cutting blade of a hand tool, and more particularly, concerns such sharpening devices that are compact and portable.

BACKGROUND OF THE INVENTION

Several cutting blade sharpening systems for hand tools are currently available. These systems are generally sold as sharpening kits and usually include: a sharpening stone which can be attached to a guide bar; a clamping device for retaining a tool having the cutting blade edge to be sharpened; and a graduated guide on the clamping device, which include several openings for receiving the guide bar. When the tool blade with the cutting edge is clamped within the clamping device, the sharpening stone is slid across the cutting edge of the blade at a prescribed angle depending on which opening of the guide arm receives the guide bar.

It is important that these sharpening assemblies be compact for them to be practical for certain applications where they are likely to be used, such as during a camping trip or in storage on the shelf of a workshop in a household. For any application, however, simplicity of operation and compact storage is preferred. However, compactness must not be achieved at the expense of convenience, ease of use, accuracy and reliability and consistency in maintaining the desired sharpening angle.

It is an object of the present invention to provide a simple sharpening assembly which is compact and can be operated with a minimum number of parts.

It is object of the present invention to provide a sharpening kit which is simple and relatively inexpensive in construction, yet convenient, accurate and reliable in use.

Another object of the present invention is to provide a sharpening hone holder which provides both effective grip and protection for the fingers of an operator.

Another object of the present invention is to provide a sharpening hone holder that can be used to accommodate parts of the sharpening kit to facilitate compact storage.

Yet another object of the present invention is to provide a support handle that can easily be attached to the present sharpener body which is inexpensive, easy to use and compact.

In accordance with one aspect of the present invention a sharpening hone holder having a support rod attached thereto is constructed to store the rod. The hone holder is used with a sharpening device of the type that includes transverse guide arms with transversely spaced openings adapted to receive the support rod and an element for maintaining a fixed relationship between the tool edge to be sharpened and the guide arms. As a result, the sharpening hone is retained at a predetermined cutting angle with respect to the cutting edge of the blade. The sharpening hone holder has a body with a support rod storage space and retaining means for selectively retaining the support rod between an extended position wherein the support rod is substantially outside the storage space and a retracted position wherein the support rod is substantially within the storage space. Additionally, means is provided for retaining the support rod in a selected position in the range including the extended and retracted positions.

The sharpening device of the present invention includes a main body, a clamping portion attached to the main body and means for tightening the clamping portion tightly towards a surface of the main body thereby being adapted to engage and securely hold the blade of a knife. In accordance with another aspect of the present invention, the tightening means is recessed within the clamping portion thereby allowing more acute angles without interfering with the movement of the hone during the sharpening operation.

In accordance with yet another aspect of the present invention, each opening along the guide arms is shaped to provide sufficient support to the support rod such that during sharpening the support rod maintains a constant cutting angle against the knife blade regardless of the relative angle between the support rod and the opening.

BRIEF DESCRIPTION OF THE DRAWINGS

The preceding objects, features and advantages of the present invention will be understood more completely from the following detailed description. Reference will be made to the accompanying drawings, in which.

DETAILED DESCRIPTION OF THE PREFERRED EMBODIMENTS

Figure 1:
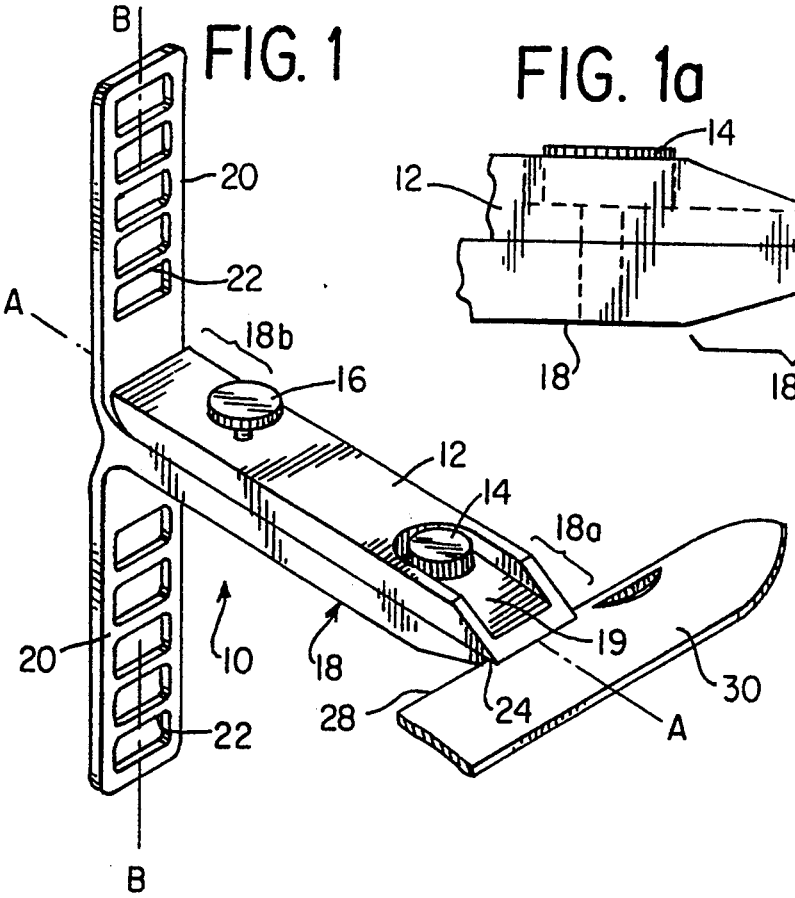
FIG. 1 is an isometric view of a sharpening device of the present invention including a portion of a clamped knife blade.
Figure 1A:
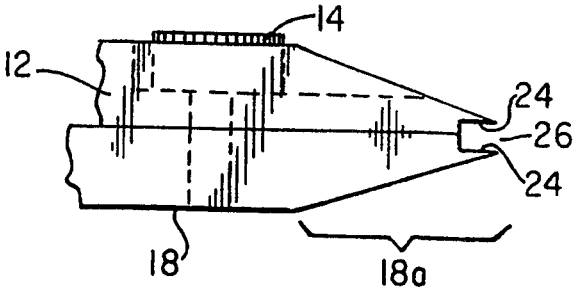
FIG. 1*a* is an enlarged partial side view of the front portion of a blade clamp in accordance with the present invention.

FIG. 1 shows a preferred embodiment of the present blade sharpener including a main body 10, a clamp bar 12, a fulcrum bolt 14 and a tightening bolt 16. The main body 10 includes a clamping portion 18 shown centered along a central axis A and two calibrated extension arm sections 20 shown centered along an axis B. Axis A is perpendicular to axis B, and both define plane C. The clamping portion 18 includes a clamping end 18*a* and a leverage end 18*b*.

Figure 6:
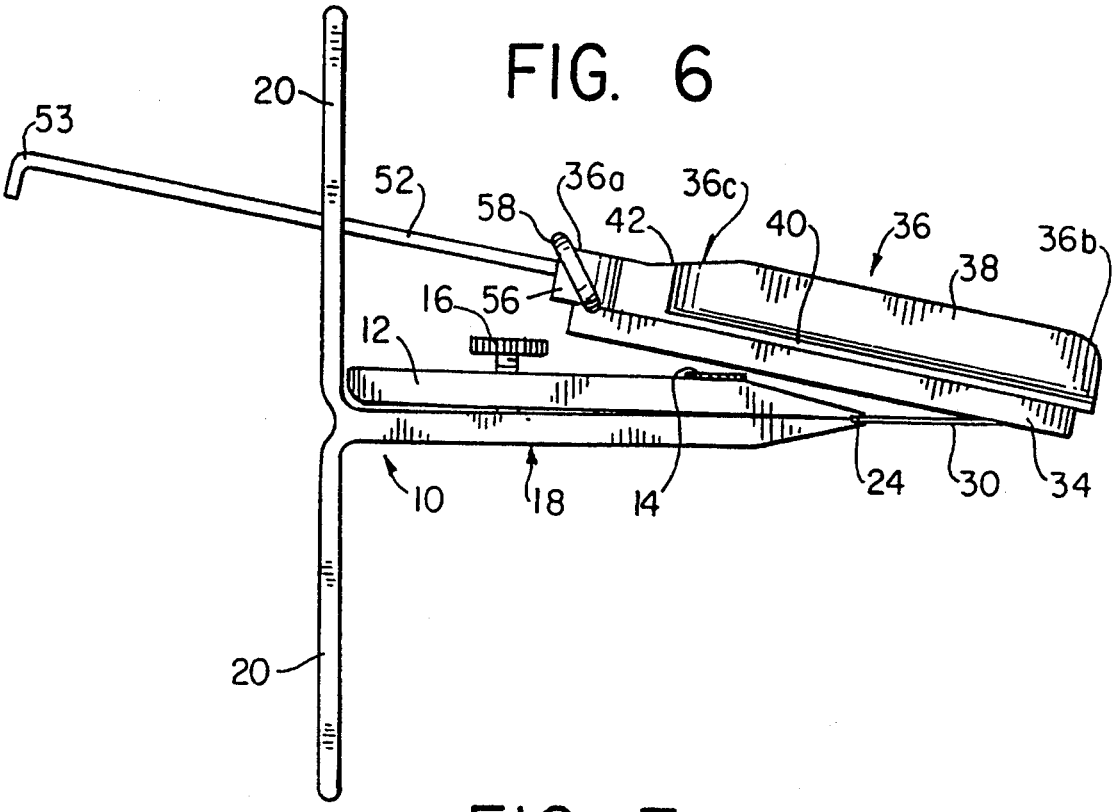
FIG. 6 is a side view of the hone holder in operating position in the blade clamp, with a blade clamped in position for sharpening.

The fulcrum bolt 14 is positioned within a bolt recess 19 which is formed in the clamp bar 12 adjacent the clamping end 18*a*. The bolt recess 19, as shown in FIG. 1 is shaped to accommodate the head portion of the fulcrum bolt 14 thereby positioning it generally below the surface of the clamp bar 12. In the preferred embodiment, however, the shape of the bolt recess 19 and its spacing from the bolt further provide an operator sufficient room to grasp the head portion of the fulcrum bolt 14, in order to rotate it during tightening or loosening of the clamp. The purpose of the bolt recess 19 is to provide a low-profile clamping end 18*a* so that the hone 34 of the hone retainer 36 (see FIG. 6) can be slid closer to the clamp bar 12 and can assume a smaller cutting angle without touching the head portion of the fulcrum bolt 14.

Each arm section 20 extends in opposing directions laterally of the leverage end 18*b* of the clamping portion 18 of the main body 10. Openings 22 are disposed along the surface of each arm section 20 and extend therethrough. The openings 22 lie along the axis B and, preferably, in the plane perpendicular to axis A.

Along the clamping end 18*a* of each of the clamping portion 18 and the clamping bar 12 lies a narrow recess 24. The recesses 24 from the clamping bar 12 and the clamping portion 18 are aligned when the clamping bar 12 is adjacent to the main body 10, and they define a combined blade recess 26 which receives the back (spine) 28 of a single cutting edge knife blade 30, or the like, as described below.

An improved sharpening hone holder 32 in accordance with the present invention is shown in FIGS. 2–6 and includes a sharpening hone 34 and a retaining member 36. The member 36 includes a front end 36*a*, a rear end 36*b* and upper and lower surfaces 36*c* and 36*d*, respectively. A grasping wall 38 is defined in the upper surface 36*c* of the member 36, extending from the rear end 36*b* towards the front end 36*a* along the longitudinal center of the member 36. The grasping wall 38 permits the operator of the sharpener to retain a firm grip while moving the hone retaining member 36. The operator positions his thumb and fingers around the grasping wall 38 to ensure a safe grip of the member 36 during the sharpening operation.

The hone retaining member 36 further includes protective flanges 40 which extend outward from and perpendicular to the grasping wall 38. The protective flanges 40 preferably extend the full length of the wall 38 and protect the user's fingers from the cutting edge of the knife blade during the sharpening operation.

The front end 36*a* of the hone retainer 36 includes a support block portion 42 which is preferably wider than the grasping wall 38, thereby defining a wall surface 44 against which the front most fingers of the operator may gain additional support during the sharpening operation. The support block 42 and the protective web 40 and grasping wall 38 are preferably molded together during the manufacture of the retainer 36, as discussed below. The front portion of the grasping wall 38 preferably merges with the wider support block 42 so that a curved wall surface 44 is formed on either side of the grasping wall 38. These curved wall surfaces 44 provide greater comfort and a more secure fit to the fingers of the operator, as well as preventing his fingers from slipping forward, beyond member 36.

A longitudinal channel 48 is formed within the hone retainer 36, extending from a point adjacent the rear end 36*b* to a point adjacent the front end 36*a*. The opening of the channel 48 faces the lower surface 36*d* of the member 36 and is substantially located within the front support block 42 and the grasping wall 38, intermediate the flanges 40.

Figure 2:
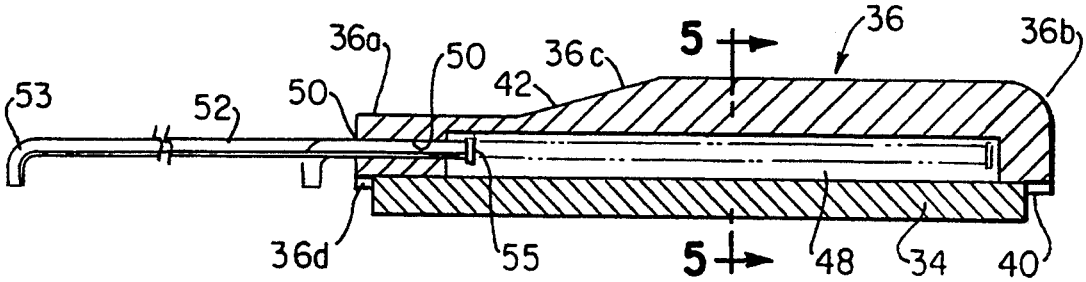
FIG. 2 is a cross sectional view of a hone holder in accordance with the present invention taken along the line 2—2 of FIG. 3 and looking in the direction of the arrows, showing a support rod in its extended position and in its retracted position (in phantom)
Figure 3:
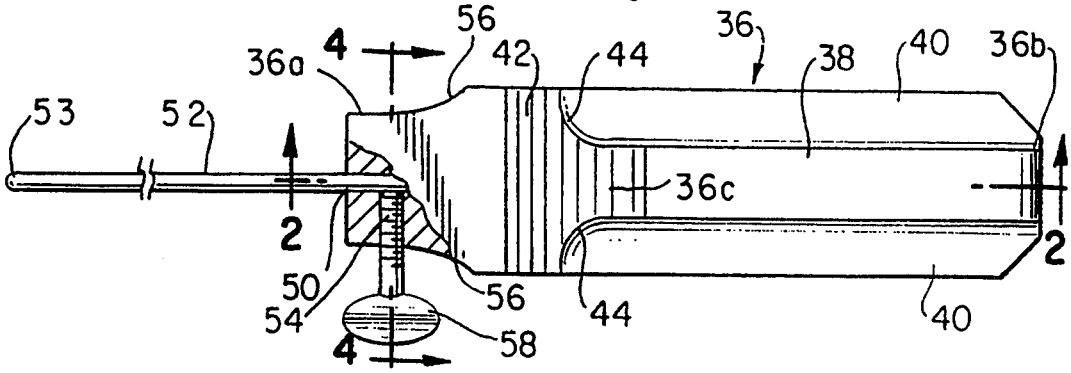
FIG. 3 is a top plan view of the hone holder with parts shown in section to show the support rod locked in the extended position.
Figure 4:
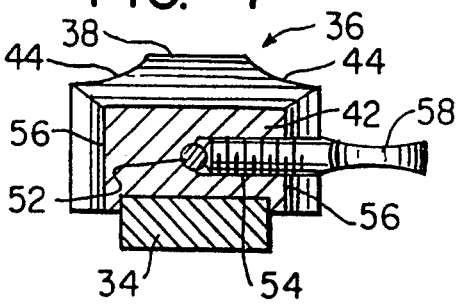
FIG. 4 is a cross sectional view of the hone holder taken along the line 4—4 of FIG. 2 and looking in the direction of the arrows.
Figure 5:
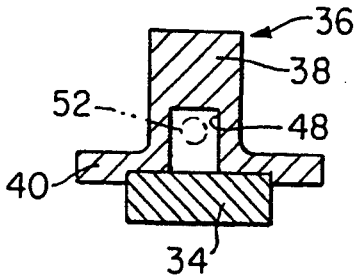
FIG. 5 is a cross sectional view of the present hone holder taken along the line 5—5 of FIG. 3 and looking in the direction of the arrows.

An opening 50 is provided at the front end 36*a* of the retainer 36. The opening 50 provides access to a passageway 51 which extends to the front end of the channel 48. A shaft portion of the support rod 52 is mounted for sliding movement within the passageway 51 and the opening 50 and enters the channel 48. The support rod 52 is movable between a retracted position, as shown in FIG. 2 (in phantom) where it is substantially housed within channel 48, and an extended position, as shown in FIGS. 2 and 3, where the rod is substantially extended outwardly of the channel 48, through opening 50. A threaded bore 54 is located on a side wall portion 56 of the support block 42 so as to intersect passageway 51. A set screw 58, (preferably in the form of a thumb and finger operable wing bolt) is received in threaded bore 54 such that by turning the set screw 58, a front portion of the set screw 58 will enter transversely into the passageway 51 to engage the shaft portion of the support rod 52. The purpose of the set screw 58 is to frictionally retain the support rod 52 and lock it in either the extended or retracted position. Since the threaded opening is located along the side wall portion 56 of the support block 42, the set screw will not interfere with the sliding movement of the hone during sharpening and will allow the hone to slide close to the arm section 20.

In the preferred embodiment, the openings 22 are generally rectangular and have a width and height which are both greater than the diameter of the support rod 52. This arrangement guides the support rod 52 and the hone retainer 36 at the desired cutting angle against the cutting edge during the sharpening operation. As the cutting edge of the blade 30 is being sharpened, the hone 34 and hone retaining member 36 are pivoted with respect to the arm section which has the opening 22 that receives rod 52. Since, the width dimension of the opening 22 is wider than the diameter of the support rod 52, the support rod 52 and the hone retainer 36 can pivot freely about the opening 22 such that the entire surface of the cutting edge can be reached. The openings 22 preferably include a bottom surface on which the support rod 52 is supported during sharpening and which is parallel to the cutting edge of the clamped blade 30. An opening 22 including the parallel support surface will assure that the cutting angle (defined by the abrading surface of the hone 34 and axis A) does not vary during sharpening even when the hone 34 is at maximum angular displacement with respect to the arm section 20 and plane C (plane C is defined by axes A and B).

The support rod 52 preferably includes a sharp bend 53 at its outermost end to aid in retaining the rod in the openings 22 during use. A flange portion 55, or the like, of the support rod end which is located within the channel 48 allows movement of the rod 52 within the channel 48 between the retracted and extended positions, but prevents the support rod 52 from being completely removed from the channel 48. The bent end 53 of the support rod 52 retains it in opening 22, but permits selective removal. In use, the bent portion is hooked through a preselected one of the openings 22 by displacing the hone retaining member 36 away from plane C.

When the hone retaining member 36 and the support rod 52 are returned to the sharpening position, the now hooked bent portion of the support rod 52 is unable to pass through the selected opening 22. This bend 53 allows the user of the device to extend the sharpening fully over its entire range of movement, without the support rod 52 slipping out of the selected opening 22. The greater the sharpening movement range of the sharpening hone 34, the faster and more smoothly the cutting edge of the blade will be sharpened and the more evenly the abrading surface of the sharpening hone will wear.

The sharpening hone 34 is preferably rectangular in shape and secured to the lower surface 36*d* of the retainer 36. A shallow recess 35 is provided into the lower surface 36*d* of the hone retainer 36 for receiving the hone 34. The recess 35 is substantially similar in shape to the contact surface of the hone 34 and provides support to the hone 34 during the sharpening operation.

The sharpening hone material is conventional, commercially available abrasive, which can be provided in various abrading grits. The sharpening hone 34 of a particular grit can be secured to the lower surface of the retainer 36 with an appropriate adhesive, such as an epoxy resin. In such instance, each hone 34 used would include a permanently fixed retainer 36. The hone 34 can also be secured to the lower surface of the retainer 36 with detachable securing means, such as using recessed bolts.

In use, the back spine of a knife blade is inserted into the combined blade recess 26. The width of the blade recess (measured between the clamping bar 12 and the clamping end 18 of the main body 10) can be adjusted by rotating the fulcrum bolt 14. This action either forces the front portion of the clamping bar 12 away from or towards the front end 18*a* of the clamping portion of the main body 10. The blade recess 26 should be adjusted until it snugly surrounds a portion of the back spine of the knife blade. The fulcrum bolt 14 is not intended to clamp the knife blade tightly to the sharpening device, but only to adjust the blade recess 26 so that the clamping mechanism will work most effectively by retainer the clamping "jaws" (clamping bar 12 and clamping portion 18) as parallel as possible.

Once the blade recess 26 is adjusted and the fulcrum bolt 14 tightened, the leverage bolt 16 is tightened, causing separation of the rear portion of the clamping bar 12 from the rear end 18*b* of the clamping portion 18. The resulting separation force effectively tends to pivot clamping bar 12 on fulcrum bolt 14 and urge together portions of the clamping bar and the main body. Since the distance between the fulcrum bolt 14 (the fulcrum point) and the secured blade is less than the distance between the fulcrum bolt 14 and the applied lifting force generated by the tightening of the leverage bolt 16, the mechanical advantage results in an increased force at the point of the blade recess. The result is that the blade of the knife can be tightly clamped by simply finger-tightening leverage bolt 16.

If a double edged knife blade is to be sharpened, it is preferred that the cutting edge which is not to be immediately sharpened be inserted past the blade recess 26, and again the fulcrum bolt be tightened so that the knife so that the clamping jaws are substantially parallel. As described above, as leverage bolt 16 is tightened, the force applied to the knife is multiplied and clamps the blade surface between the clamping bar 12 and the main body 10.

In either case, once the knife blade is tightly clamped to the sharpening device, the appropriate sharpening hone 34 can be chosen, depending on the type of blade being sharpened and its condition. The support rod 52 is unlocked from frictional engagement with the set screw 54 and removed from the storage channel 48 to the fully extended position. The set screw 54 is then re-tightened in order to lock the support rod 52 in the fully extended position and to provide rigid support to the support rod 52 with respect to the retainer 36.

The remote end of the support rod 52 is inserted into an appropriate opening 22 of either arm section 20, depending on which side of the cutting edge is to be sharpened and the desired sharpening angle. The openings 22 are preferably positioned along the arm sections 20 such that the sharpening hone 34, with the aid of the support rod 52 can be maintained along the cutting edge of the clamped blade at selected angles of 17, 20, 25, 30 and 35 arc degrees, as measured from the central axis A. Appropriate indicia is provided adjacent each opening 20 to indicate its corresponding cutting arc degree.

Figure 7:
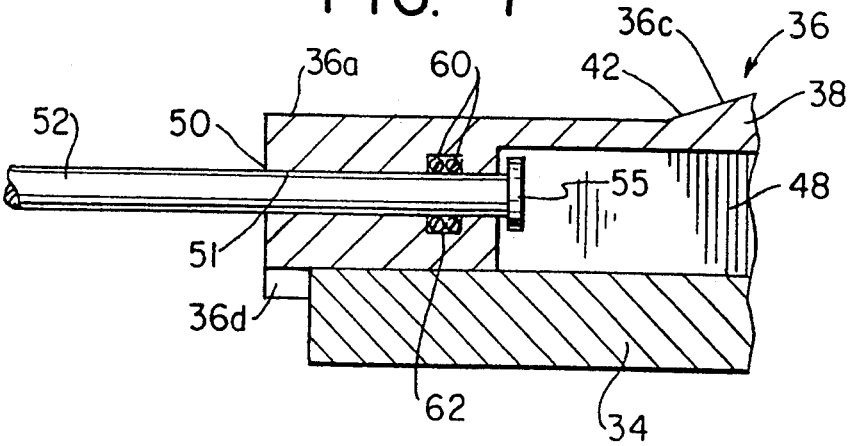
FIG. 7 is an enlarged partial cross section view similar to FIG. 2, showing a second embodiment of the present hone holder.

In another embodiment of the present invention, the set screw 58 is replaced by an annular rubber grommet 60. In this embodiment, shown in FIG. 7, the grommet 60 is positioned along the passageway 51. Grommet 60 is preferably seated within a circumferential groove 62 in the passageway 51 to restrain grommet 60 during movement of the support rod 52. The inside diameter of grommet 60 is less then the outside diameter of the support rod 52. As a result, support rod 52 is slidably received within and in frictional contact with grommet 60. By design, this frictional contact is such that the support rod 52 can be slid by hand between the retracted position and the extended position without causing damage to the grommet material. However, the grommet 60 will frictionally retain support rod 52 in position during the normal sharpening operation.

Figure 8:
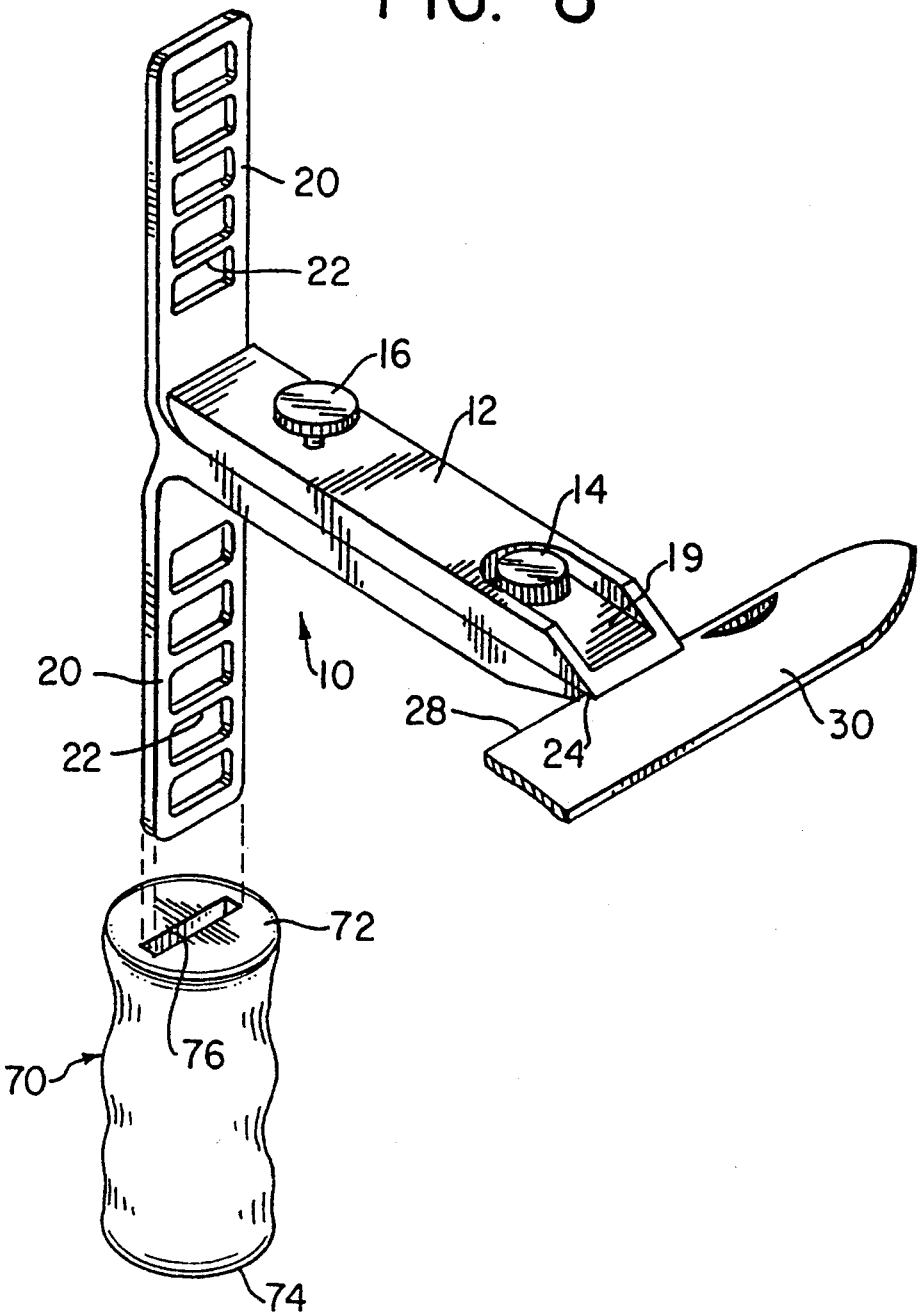
FIG. 8 is an isometric view of the present sharpening device including a support handle of the present invention.

In yet another embodiment of the present invention shown in FIG. 8, a removable support handle 70 is provided for main body 10, giving the operator comfortable leverage of the sharpener device during the sharpening operation. The support handle 70, as shown in FIG. 8 is substantially cylindrical in shape having pre-formed finger holds and includes a comfortable, non-slip gripping surface for either hand of the operator. The handle has an upper end face 72 and a lower end face 74. The handle 70 includes a slot 76 extending through the upper end face 72 and into .the cylindrical handle 70 towards the lower end face 74, but not necessarily reaching the lower end face 74. The slot 76 is dimensioned and shaped to receive the unused (usually the lower) arm section 20. During normal use of the present sharpener, while sharpening a cutting edge of a blade, one arm section 20 will not be used to guide the support rod 52. In this present embodiment, the unused arm section will be inserted in the handle 70 so that the operator may hold the handle 70 and thereby comfortably support the sharpening device while one particular side of the cutting edge is sharpened. When the other side of the cutting edge of the clamped blade is to be sharpened, the clamp is inverted and the other arm section 20 is inserted into slot 76 of handle 70.

The material of the handle 70 is preferably a slightly resilient plastic, such as a rubberized plastic. The slot 76 is preferably slightly smaller in size than the arm section 20 so as to provide a slight interference fit for handle 70.

As is well known in this art handles such as handle 70 may be adapted to be independently supported, as by being provided with a threaded shaft at the bottom, to be received in a supporting bracket, or by including a portion which may be clamped in a vise.

What is claimed is:

1. A portable hand held blade sharpening device comprising:

a main body having a front;

a clamping bar adjustably attached in opposed relationship to said main body for retaining a blade to be sharpened therebetween and at the front of said main body, said clamping bar having an upper surface with a cavity formed therein;

means for guiding a sharpening hone against said blade at a predetermined cutting angle; and means for adjusting said clamping bar relative to said main body, said adjustment means including a bolt having a hand operable head portion which is recessed in said cavity, said cavity being open towards the front of said main body and in a direction generally perpendicular to the length of said bolt to provide access to said head portion directly by the fingers of an operator without requiring the use of tools, said recessed head of said bolt allowing a smaller cutting angle between said sharpening hone and said blade without interference with said sharpening hone.

2. A portable hand held sharpening device, comprising:

a main body;

means for clamping a blade to be sharpened to said main body;

a sharpening hone for abrading said blade to be sharpened;

guiding arms formed as integral extensions of said main body so as to project therefrom, said guide arms having guide openings for guiding the movement of a sharpening hone at a predetermined cutting angle against said blade; and a support handle having an attachment opening sized and shaped to selectively receive either of said guiding arms for allowing an operator to comfortably hold the device during the sharpening operation.

3. The sharpening device according to claim 2 wherein said handle is generally cylindrical and includes a hand-grip surface.

4. The sharpening device according to claim 3 wherein said handle is made from a rubberized material and said support opening is sized and shaped slightly smaller than the size and shape of said either of said guiding arms, said rubberized material being such that said handle can deform snugly around either of said guiding arms sufficient to provide support to said operator and remain easily removable when desired.

* * * * *